US008702874B2

(12) United States Patent
Montgomery et al.

(10) Patent No.: US 8,702,874 B2
(45) Date of Patent: Apr. 22, 2014

(54) METHOD AND SYSTEM FOR REMOVING A CLOG FROM A DISHWASHER

(75) Inventors: Mark D. Montgomery, Greenville, NC (US); Virgil J. Francisco, Ayden, NC (US); Christopher B. Lambert, Kinston, NC (US); John DeFilippi, Stockholm (SE)

(73) Assignee: Electrolux Home Products, Inc., Charlotte, NC (US)

( * ) Notice: Subject to any disclaimer, the term of this patent is extended or adjusted under 35 U.S.C. 154(b) by 400 days.

(21) Appl. No.: 13/022,942

(22) Filed: Feb. 8, 2011

(65) Prior Publication Data

US 2012/0199162 A1 Aug. 9, 2012

(51) Int. Cl.

*B08B 7/00* (2006.01)
*B08B 7/04* (2006.01)
*B08B 3/00* (2006.01)

(52) U.S. Cl.

USPC ..... 134/56 D; 134/57 D; 134/58 D; 134/18; 134/25.2

(58) Field of Classification Search

USPC ..... 134/18, 25.2, 57 D, 56 D, 58 D; 137/387
See application file for complete search history.

(56) References Cited

U.S. PATENT DOCUMENTS

| | | | |
|---|---|---|---|
| 2,882,366 | A | 4/1959 | Fay |
| 3,439,687 | A | 4/1969 | Cushing |
| 3,464,437 | A | 9/1969 | Zane |
| 3,835,880 | A | 9/1974 | Hoffman et al. |
| 3,844,299 | A | 10/1974 | Athey et al. |
| 3,846,615 | A | 11/1974 | Athey et al. |
| 3,986,372 | A | 10/1976 | Karklys |
| 4,069,425 | A | 1/1978 | Cushing |
| 4,180,095 | A | 12/1979 | Woolley et al. |
| 4,241,400 | A | 12/1980 | Kiefer |
| 4,245,310 | A | 1/1981 | Kiefer |
| 4,271,861 | A | 6/1981 | Crawford |
| 4,301,829 | A | 11/1981 | Rowe |
| 4,318,084 | A | 3/1982 | Scott et al. |
| 4,334,143 | A | 6/1982 | Cushing |
| 4,796,473 | A | 1/1989 | Custer |
| 5,018,550 | A | 5/1991 | Burdorff |
| 5,361,439 | A | 11/1994 | Malchow |
| 5,611,867 | A | 3/1997 | Cooper et al. |
| 5,669,983 | A | 9/1997 | Cooper et al. |
| 5,755,244 | A | 5/1998 | Sargeant et al. |
| 5,762,080 | A | 6/1998 | Edwards et al. |
| 5,770,058 | A | 6/1998 | Jozwiak |

(Continued)

FOREIGN PATENT DOCUMENTS

| | | |
|---|---|---|
| DE | 35 13 640 | 10/1986 |
| DE | 36 23 081 | 1/1988 |

(Continued)

*Primary Examiner* — Alexander Markoff
(74) *Attorney, Agent, or Firm* — Alston & Bird LLP

(57) ABSTRACT

Embodiments of the present invention are related to a method and an associated system for removing a forming or fully developed clog from a drain hose in a dishwasher. According to one embodiment, the system includes a drain pump configured to remove water from the dishwasher and a drain hose in fluid communication with the drain pump. The system further includes a control device in operable communication with the drain pump and configured to execute a drain routine in response to detecting a clog in the drain hose, wherein the drain routine comprises repeatedly activating and deactivating the drain pump to facilitate removal of the clog.

27 Claims, 11 Drawing Sheets

(56) References Cited

U.S. PATENT DOCUMENTS

| | | | | |
|---|---|---|---|---|
| 5,797,409 | A | 8/1998 | Cooper et al. | |
| 5,806,541 | A | 9/1998 | Cooper et al. | |
| 5,957,144 | A | 9/1999 | Neff et al. | |
| 6,007,640 | A | 12/1999 | Neff et al. | |
| 6,103,017 | A * | 8/2000 | Thies et al. | 134/10 |
| 6,125,870 | A | 10/2000 | Furmanek | |
| 6,129,110 | A | 10/2000 | Kolb | |
| 6,752,875 | B2 | 6/2004 | Kiesler et al. | |
| 6,811,617 | B2 | 11/2004 | Elick et al. | |
| 7,146,670 | B2 | 12/2006 | McGill et al. | |
| 7,232,494 | B2 | 6/2007 | Rappette | |
| 7,241,347 | B2 | 7/2007 | Elick et al. | |
| 7,472,714 | B2 | 1/2009 | Elick et al. | |
| 7,520,283 | B2 | 4/2009 | Lee | |
| 7,556,050 | B2 | 7/2009 | Lee | |
| 2002/0108441 | A1 | 8/2002 | Liu | |
| 2003/0056300 | A1 | 3/2003 | Ruhl et al. | |
| 2004/0255988 | A1 | 12/2004 | DuHack et al. | |
| 2005/0051201 | A1 * | 3/2005 | Ashton et al. | 134/104.1 |
| 2005/0241675 | A1 | 11/2005 | Jung et al. | |
| 2006/0174917 | A1 * | 8/2006 | Hedstrom et al. | 134/25.2 |
| 2006/0237035 | A1 * | 10/2006 | Ferguson et al. | 134/10 |
| 2006/0237052 | A1 | 10/2006 | Picardat et al. | |
| 2007/0017551 | A1 | 1/2007 | Hartogh | |
| 2008/0078243 | A1 | 4/2008 | Jeon et al. | |
| 2008/0163930 | A1 * | 7/2008 | Ha | 137/1 |
| 2009/0078288 | A1 * | 3/2009 | Son | 134/18 |
| 2012/0000535 | A1 * | 1/2012 | Poyner et al. | 137/1 |

FOREIGN PATENT DOCUMENTS

| | | |
|---|---|---|
| DE | 38 39 200 | 5/1990 |
| DE | 40 22 439 | 1/1992 |
| DE | 42 19 146 | 12/1992 |
| DE | 42 38 450 | 5/1994 |
| DE | 103 12 744 | 9/2004 |
| DE | 10 2006 013 312 | 5/2007 |
| EP | 0 669 099 | 8/1985 |
| EP | 0 461 722 | 12/1991 |
| GB | 2 038 171 | 7/1980 |
| GB | 2 123 148 | 1/1984 |
| GB | 2 139 084 | 11/1984 |
| JP | 2002065566 | 3/2002 |
| JP | 2002065567 | 3/2002 |

* cited by examiner

METHOD AND SYSTEM FOR REMOVING A CLOG FROM A DISHWASHER

FIELD

Embodiments of the present invention relate to dishwashers and, more particularly, to a method, an associated system for removing a clog from a drain hose in a dishwasher.

BACKGROUND

Dishwashers have become an integral part of everyday household use. Typical dishwashers use water pumped into a tub to clean dishes and utensils, and wash cycles often use multiple water fills. The water pumped into the dishwasher along with soils from the dishes and utensils are removed through a drain hose. The soils can build up over time especially at a restriction in the drain circuit, making it possible to overwhelm or clog the drain hose with large dense soils. A clog in the drain hose can contribute to flooding of the dishwasher and will likely lead to ineffective cleaning of the dishes and utensils.

Therefore, there exists a need for a method and system for effectively removing clogs in the drain hose to prevent flooding and enable proper cleaning during dishwasher cycles.

SUMMARY OF THE INVENTION

In light of the foregoing background, embodiments of the present invention provide an effective method and system for removing a clog from a drain hose in a dishwasher.

One embodiment is directed to a method of manufacturing a dishwasher for removing a clog from a drain hose. The method includes the steps of providing a dishwasher comprising: (i) a drain pump configured to remove water from the dishwasher; (ii) a drain hose in fluid communication with the drain pump; and (iii) a control device in operable communication with the drain pump. The method also includes configuring the control device to execute a drain routine in response to detecting a clog in the drain hose, wherein the drain routine comprises repeatedly activating and deactivating the drain pump to facilitate removal of the clog.

According to one embodiment, the method comprises providing a dishwasher including a detection device for detecting an overfill condition in the dishwasher, the overfill condition corresponding to a water level in the dishwasher that is greater than a predetermined threshold. In another embodiment, the drain routine may comprise repeatedly activating and deactivating the drain pump until the overfill condition is removed.

In some embodiments, the drain routine may further comprise repeating the steps of detecting an overfill condition and executing the drain routine a plurality of times. The drain routine may also comprise signaling a drain clog error upon detection of an overfill condition a plurality of times.

In other embodiments, the drain routine may further comprise activating the drain pump for a first pre-determined time period, deactivating the drain pump for a second pre-determined time period, and activating the drain pump for a third pre-determined time period. The drain routine may further comprise the step of repeating the steps of activating the drain pump for a first pre-determined time period and deactivating the drain pump for a second pre-determined time period a plurality of times before activating the drain pump for a third pre-determined time period.

Another embodiment of the present invention includes a system for removing a clog from a drain hose in a dishwasher. The system comprises a drain pump configured to remove water from the dishwasher, a drain hose in fluid communication with the drain pump, and a control device in operable communication with the drain pump and configured to execute a drain routine in response to detecting a clog in the drain hose, wherein the drain routine comprises repeatedly activating and deactivating the drain pump to facilitate removal of the clog. In one embodiment, the drain routine comprises repeatedly activating and deactivating the drain pump for pre-determined time periods so as to facilitate removal of the clog. In addition, the control device may be configured to provide a signal to resume operation of the dishwasher upon removal of the clog.

According to one aspect, the system further includes a detection device configured to detect a clog in the drain hose, wherein the control device is in operable communication with the detection device and is configured to execute a drain routine in response to the detection device detecting a clog in the drain hose. The detection device may be further configured to detect an overfill condition in the dishwasher, wherein the overfill condition corresponds to a water level in the dishwasher that is greater than a predetermined threshold. The detection device may be further configured to detect removal of the overfill condition, wherein the drain routine comprises repeatedly activating and deactivating the drain pump until the detection device detects removal of the overfill condition. Moreover, the control device may be further configured to signal a drain clog error in response to the detection device detecting an overfill condition a plurality of times.

According to additional aspects, the detection device is further configured to detect a clog based on identifying a reduced drain fluid discharge rate from the dishwasher. The detection device may be further configured to detect removal of the clog, wherein the drain routine comprises repeatedly activating and deactivating the drain pump until the detection device detects removal of the overfill condition. The control device may be further configured to signal a drain clog error in response to the detection device detecting a reduced drain fluid discharge rate a plurality of times.

Other embodiments of the present invention include a method and computer program product for removing a clog from a drain hose in a dishwasher, wherein the dishwasher comprises a drain pump for removing water from the dishwasher and in fluid communication with the drain hose. For example, the method includes detecting a clog in the drain hose and executing a drain routine in response to detecting a clog in the drain hose, wherein the drain routine comprises repeatedly activating and deactivating the drain pump to facilitate removal of the clog.

BRIEF DESCRIPTION OF THE SEVERAL VIEWS OF THE DRAWINGS

Figure 1:
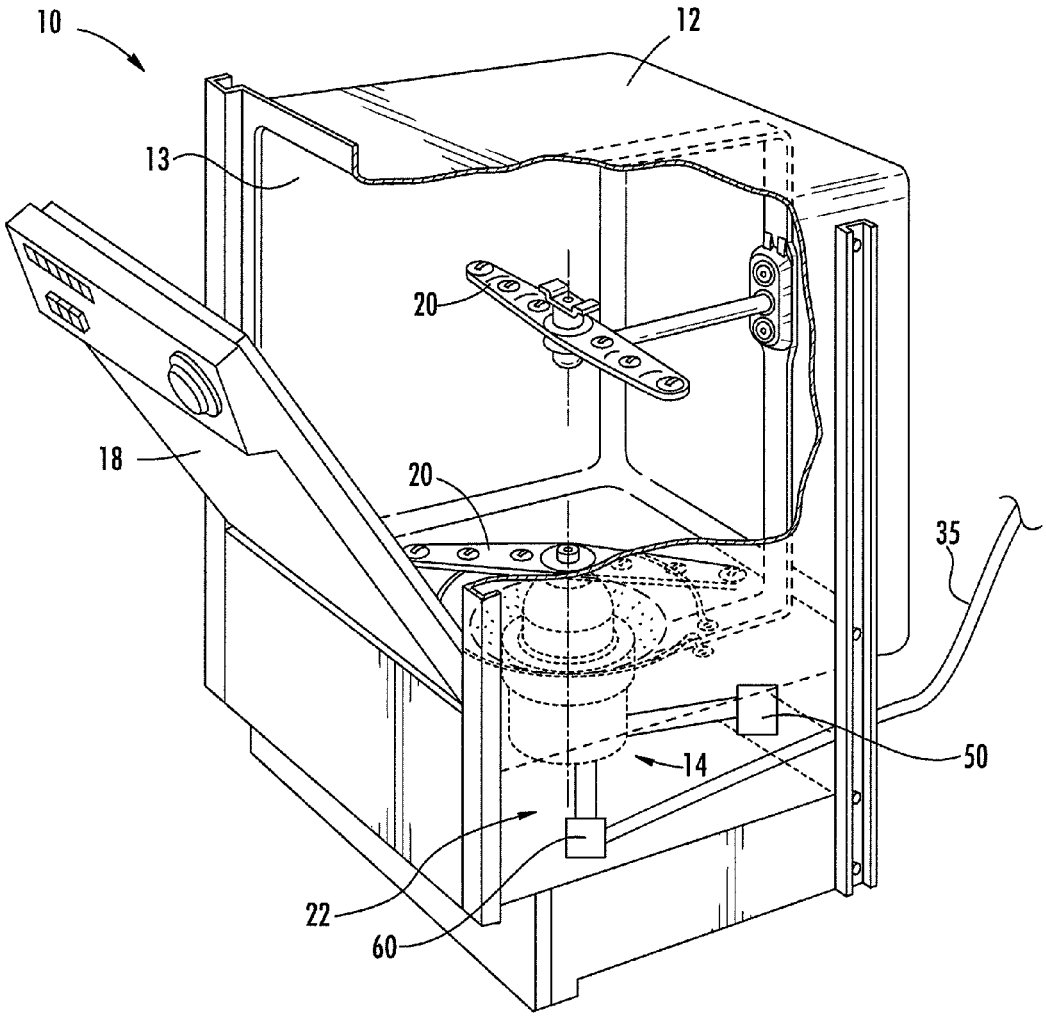
Figure 2:
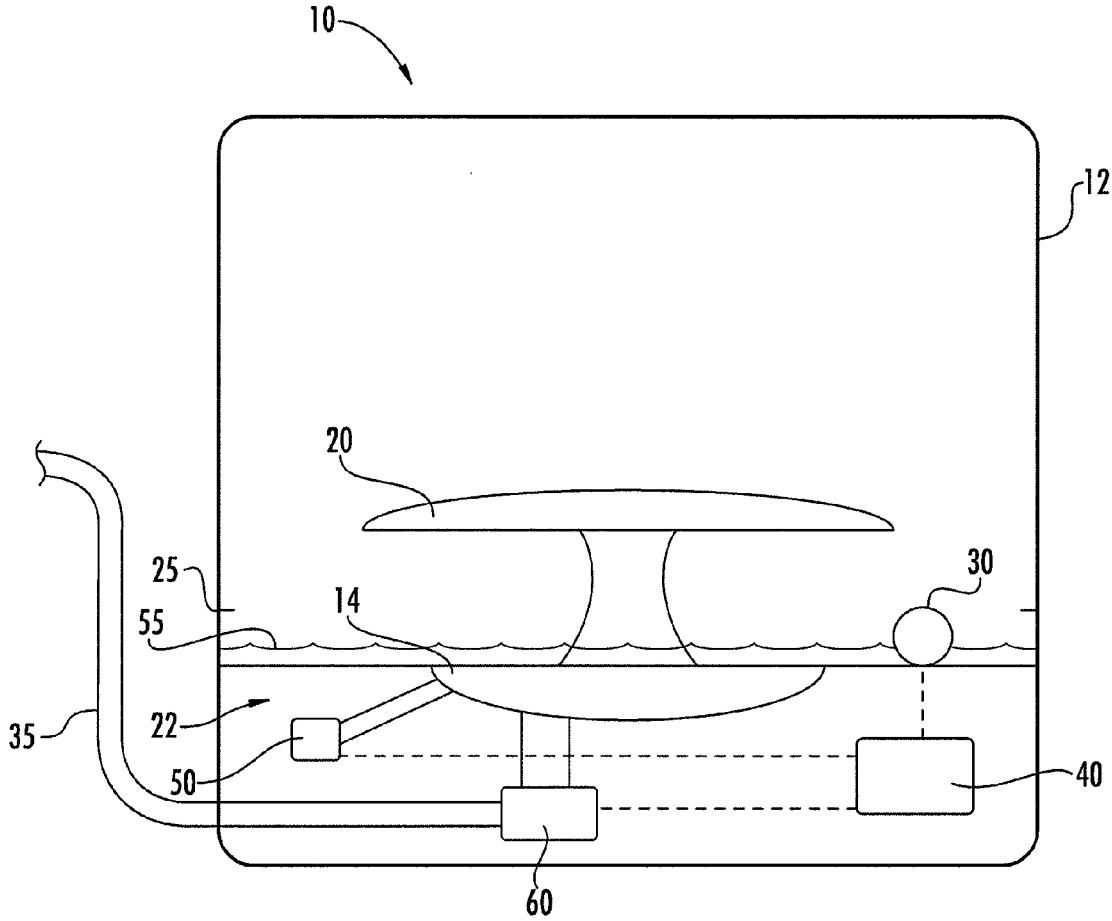
Figure 3:
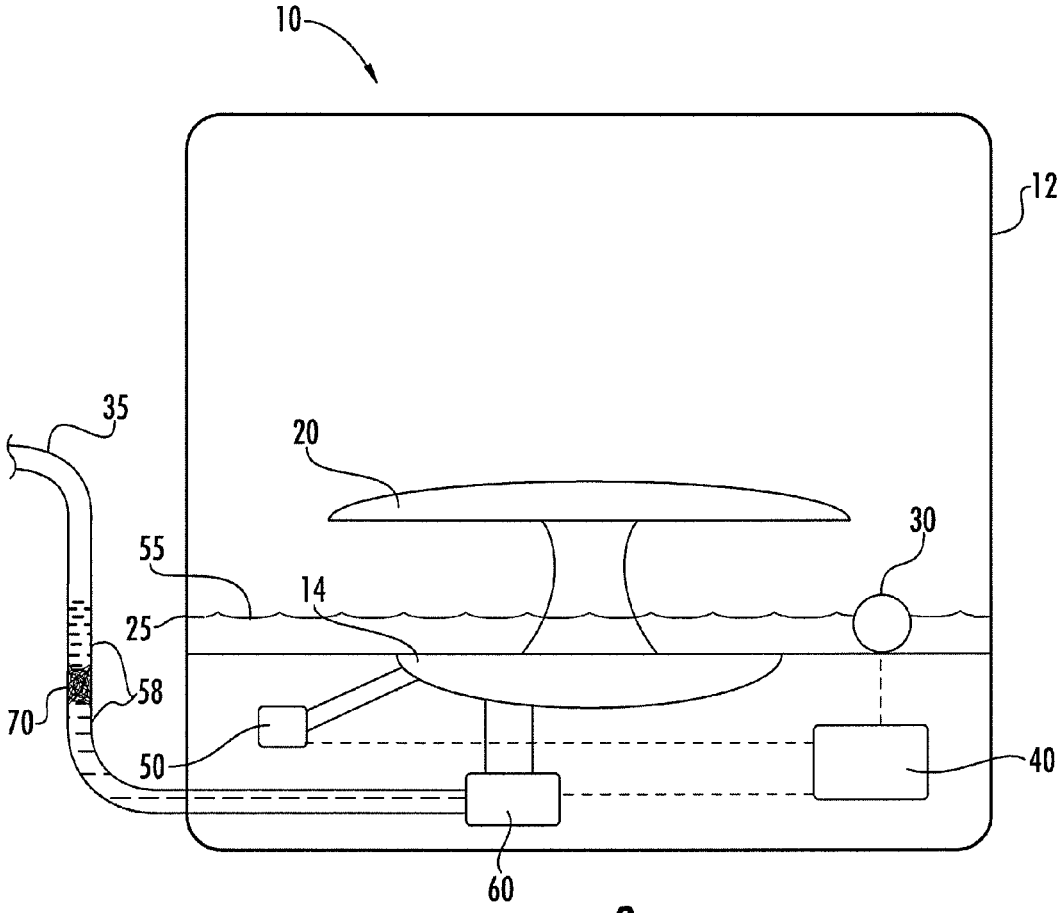
Figure 4:
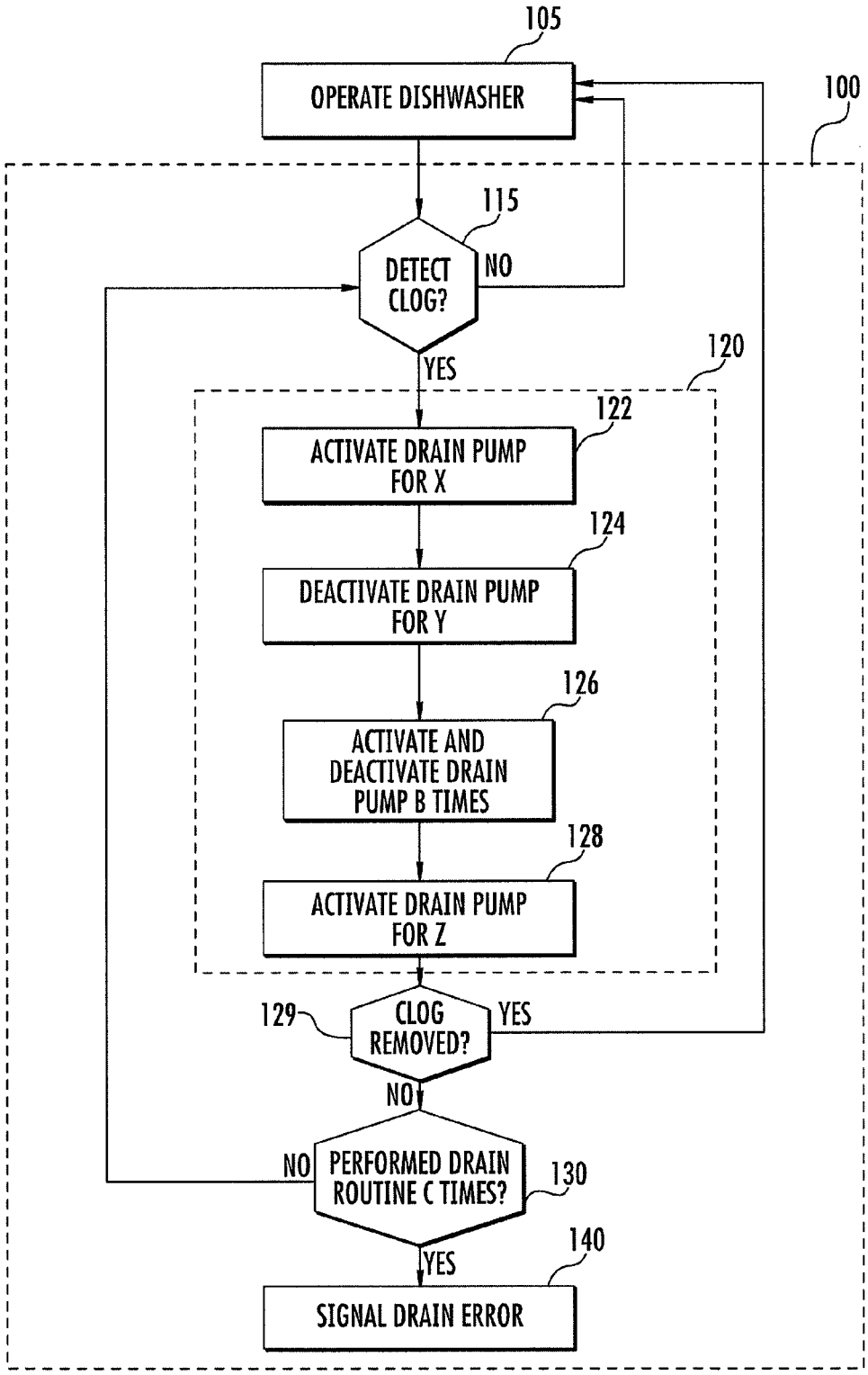
Figure 5:
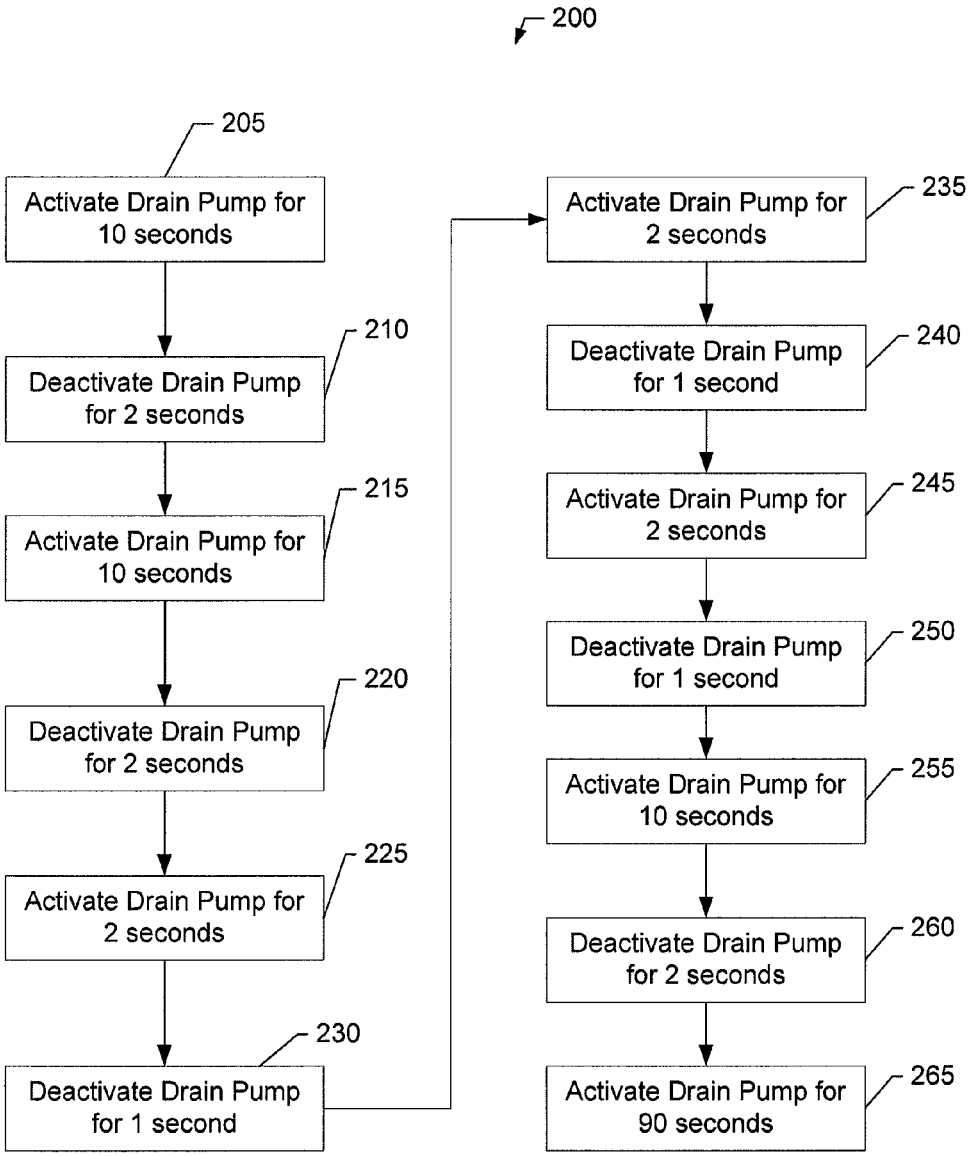
Figure 6:
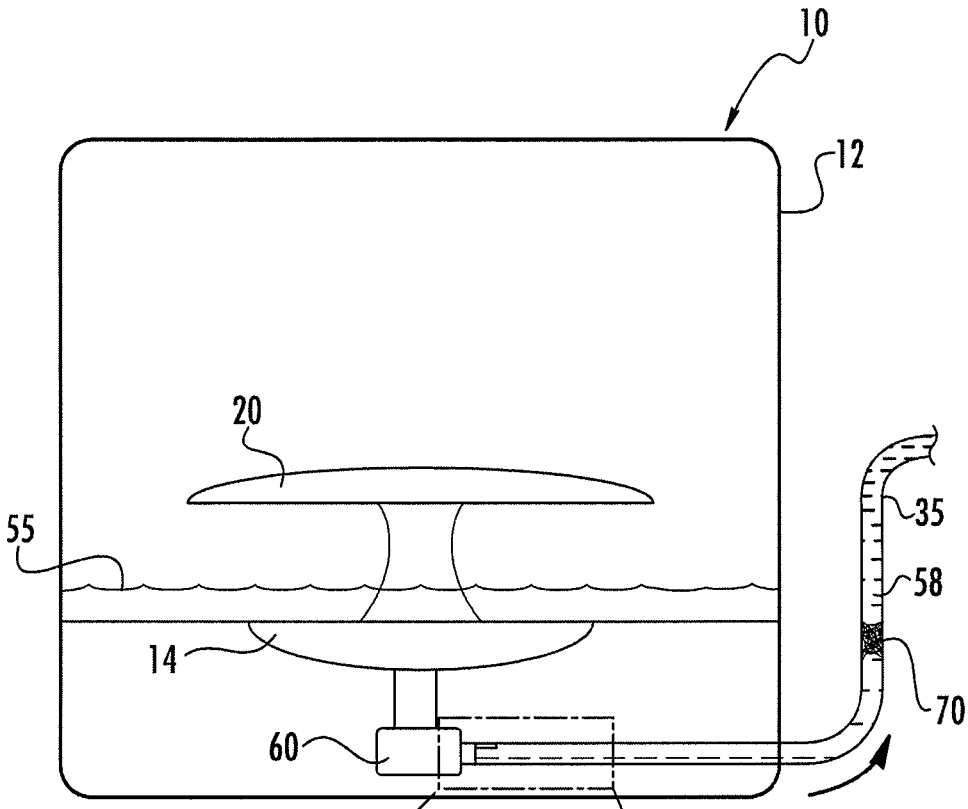
Figure 6A:
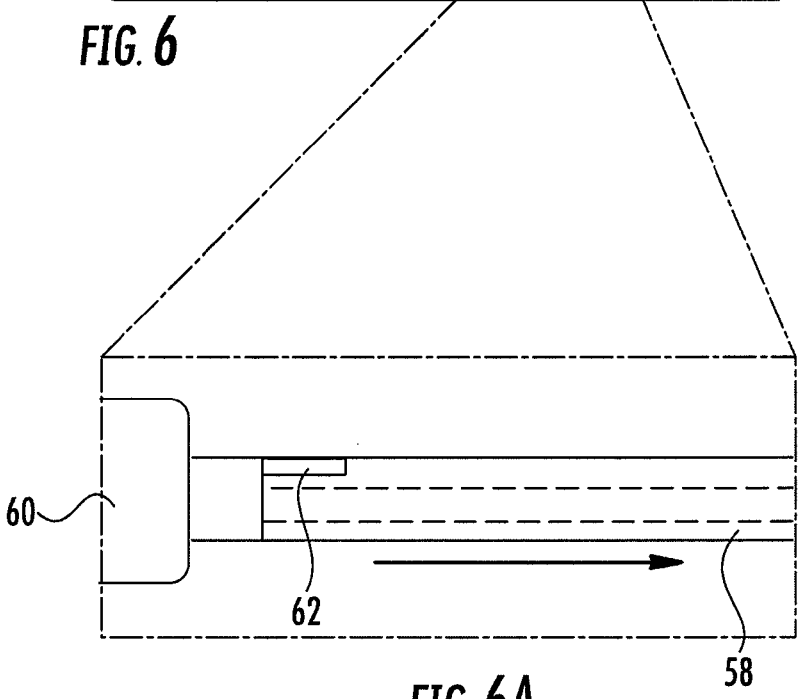
Figure 7:
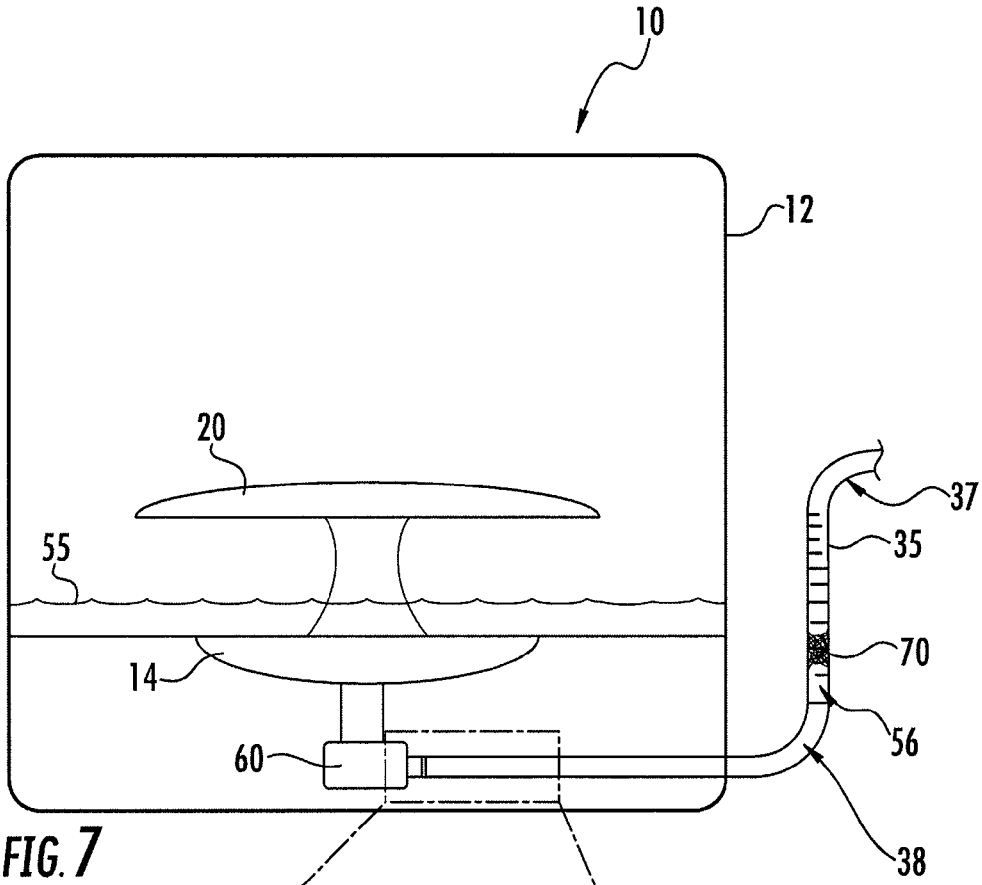
Figure 7A:
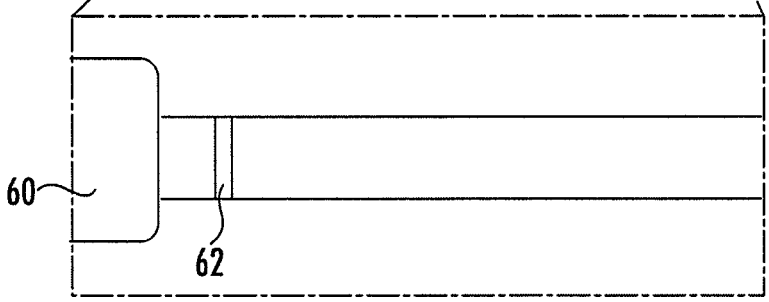
Figure 8:
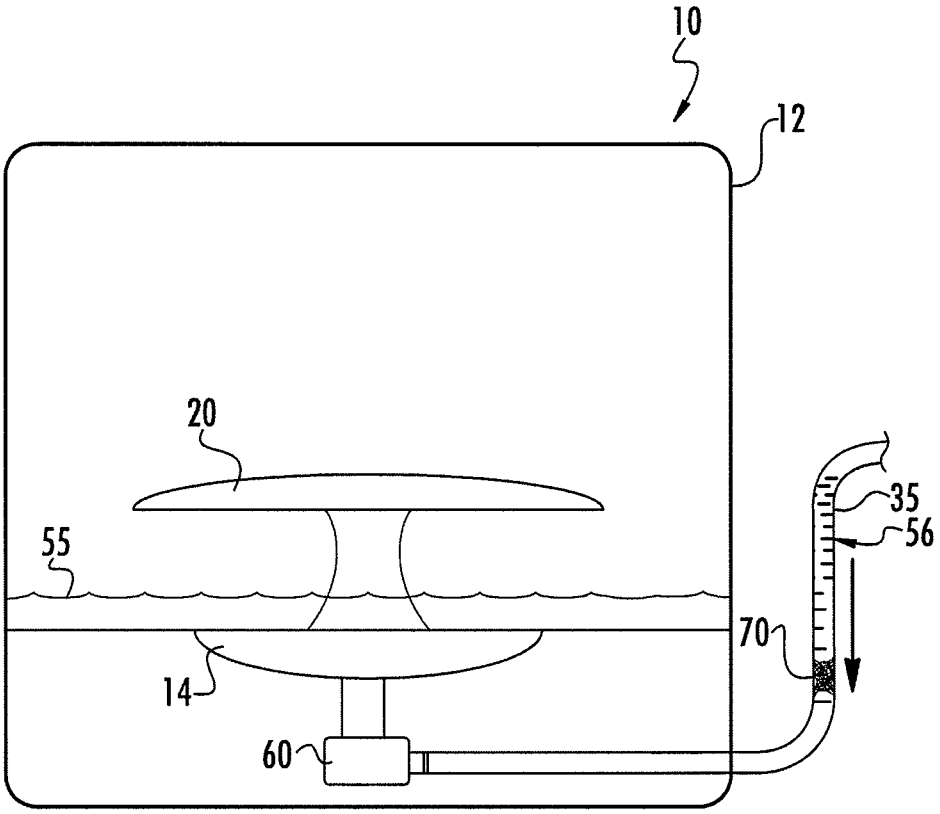
Figure 9:
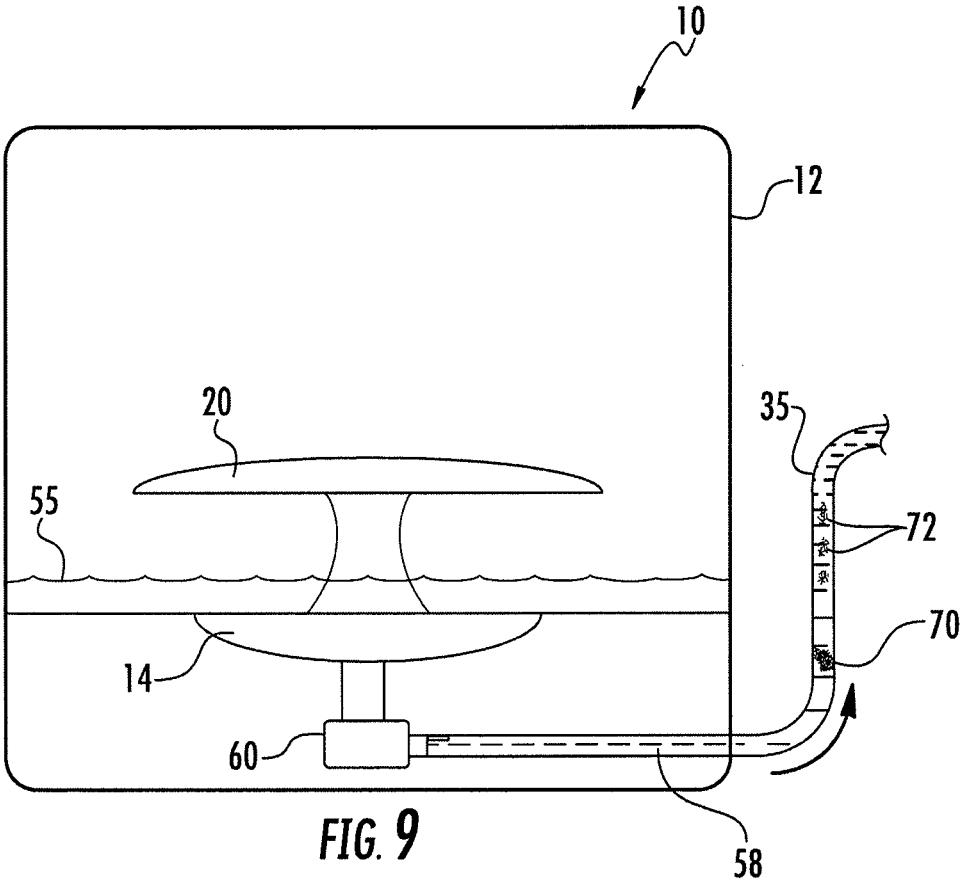
Figure 10:
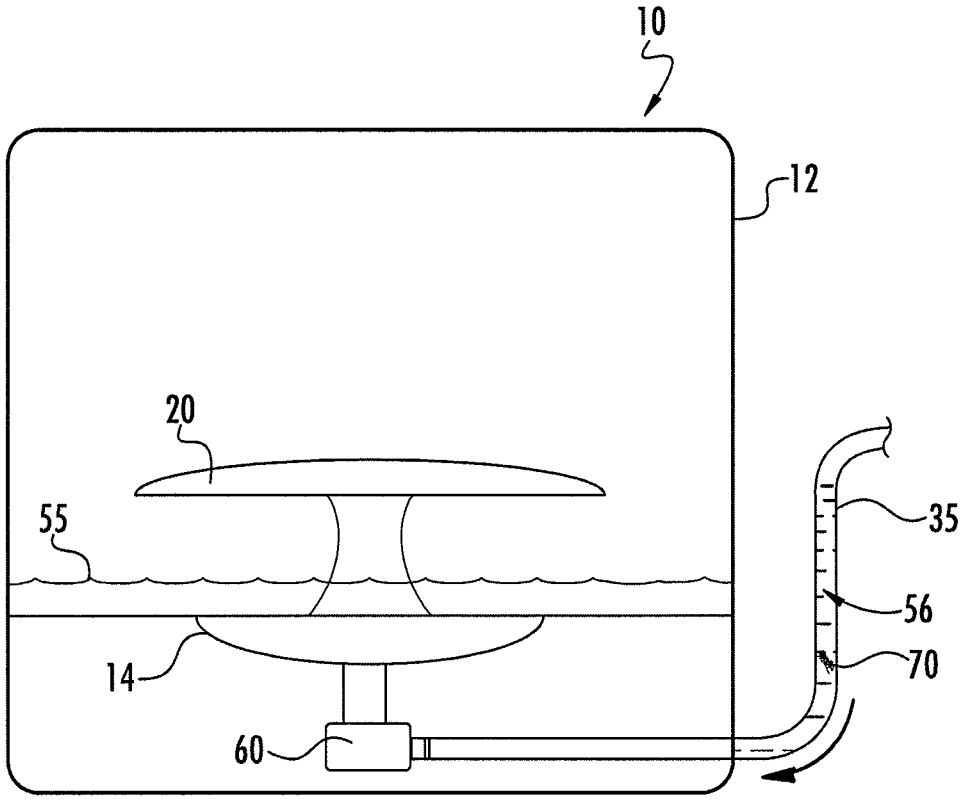
Figure 11:
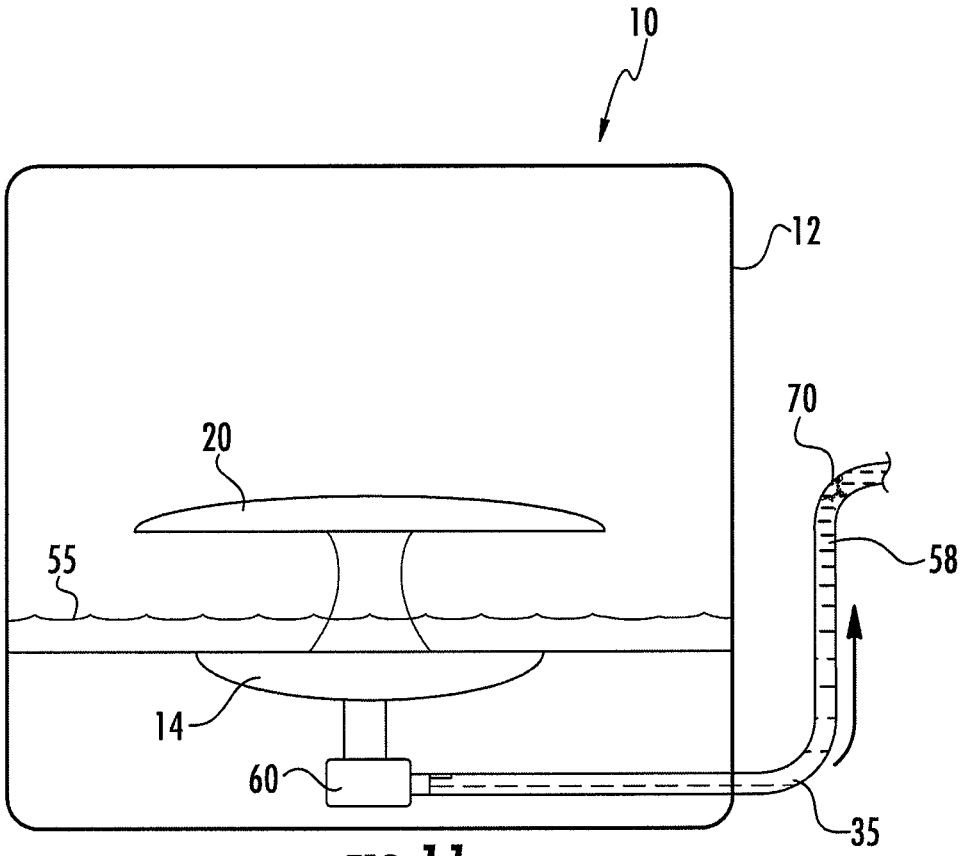

Having thus described the invention in general terms, reference will now be made to the accompanying drawings, which are not necessarily drawn to scale, and wherein:

FIG. 1 is a perspective view of a partially exposed dishwasher, in accordance with some embodiments discussed herein;

FIG. 2 is a cross-sectional front view of a dishwasher, in accordance with some embodiments discussed herein;

FIG. 3 is a cross-sectional front view of a dishwasher, wherein an overfill condition has occurred in the dishwasher resulting from a clog in a drain hose, in accordance with some embodiments discussed herein;

FIG. 4 is a flowchart that illustrates a method for removing a clog from a drain hose in a dishwasher, in accordance with some embodiments discussed herein;

FIG. 5 is a flowchart that illustrates another embodiment of a method for removing a clog from a drain hose in a dishwasher, in accordance with some embodiments discussed herein;

FIG. 6 is a cross-sectional front view of a dishwasher, wherein a drain hose in the dishwasher is clogged and the drain pump is activated, in accordance with some embodiments discussed herein;

FIG. 6A is an enlarged cross-sectional view of a drain pump and drain hose of the dishwasher of FIG. 6, wherein a check valve is open and water is entering the drain hose, in accordance with some embodiments discussed herein;

FIG. 7 is a cross-sectional front view of the dishwasher of FIG. 6, wherein the drain pump is deactivated and a water column forms, in accordance with some embodiments discussed herein;

FIG. 7A is an enlarged cross-sectional view of the drain pump and drain hose of the dishwasher of FIG. 6, wherein the check valve is closed, in accordance with some embodiments discussed herein;

FIG. 8 is a cross-sectional front view of the dishwasher of FIG. 6, illustrating the force of gravity on the water column and clog, in accordance with some embodiments discussed herein;

FIG. 9 is a cross-sectional front view of the dishwasher of FIG. 6, wherein the drain pump is activated, illustrating the removal of some smaller soils from the clog, in accordance with some embodiments discussed herein;

FIG. 10 is a cross-sectional front view of the dishwasher of FIG. 6, wherein the drain pump is deactivated and a second water column forms, illustrating the force of gravity on the second water column and the clog, in accordance with some embodiments discussed herein; and FIG. 11 is a cross-sectional front view of the dishwasher of FIG. 6, wherein the drain pump is activated, wherein removal of the clog from the drain hose is illustrated, in accordance with some embodiments discussed herein.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates one example of a dishwasher 10 capable of implementing various embodiments of the present invention. Such a dishwasher 10 typically includes a tub 12 (partly broken away in FIG. 1 to show internal details), having a plurality of walls (e.g., side wall 13) for forming an enclosure in which dishes, utensils, and other dishware may be placed for washing. As known in the art, the dishwasher 10 may also include slidable lower and upper racks (not shown) for holding the dishes, utensils, and dishware. A door 18 may be pivotably engaged with the tub 12 to selectively permit access to the interior of the tub 12. The door 18 closes to cover and seal the tub 12 when the dishwasher 10 is in operation.

The tub 12 may include a sump 14 in which wash water or rinse water is collected, typically under the influence of gravity. The wash/rinse water may be pumped by a circulation pump to one or more spray arms 20 mounted in the interior of the tub 12 for spraying the wash/rinse water, under pressure, onto the dishes, utensils, and other dishware contained therein.

The sump 14 and spray arms 20 may be in fluid communication with various operational components of the dishwasher 10. For example, a water valve 50 and a drain pump 60 may each be in fluid communication with the sump 14 and spray arms 20. The water valve 50 may be configured to open, or turn ON, to direct water from a fluid supply/source (not shown) or the sump 14 to the spray arms 20 or otherwise to the tub 12 of the dishwasher 10. The water valve 50 may also be configured to close, or turn OFF, to stop directing water to the tub 12. The drain pump 60 may be configured to actuate or activate or turn ON, to remove water from the sump 14 or tub 12, as well as being configured to deactuate or deactivate or turn OFF, to stop removing water from the sump 14 or tub 12. Thus, through selective actuation of the water valve 50/drain pump 60, water may be selectively added or removed from the dishwasher 10. The drain pump 60 and the water valve 50 may be configured to be automatically actuated (i.e., electrically opened and closed), though one skilled in the art will appreciate that such components may be actuated in different ways such as, for example, mechanically, hydraulically, and/or in other appropriate manners.

Water and soil collected in the sump 14 can be pumped out of the dishwasher 10 by the drain pump 60 through a drain hose 35. The drain hose 35 comprises a hose that extends from the drain pump 60, or otherwise from the dishwasher 10, to a typical home drain plumbing system and is configured to remove water and soils from the dishwasher 10 to the home drain plumbing. As shown in FIGS. 2 and 3, a drain hose 35 may be configured with a steep rise from the drain pump 60. The change in direction may create a pinch point or region of reduced cross sectional area for flow, particularly near the bend closest to the drain pump 60. This bend at the bottom of the steep rise is also a settling sight for soils that are heavier than water making this location highly susceptible to clogging from soil build-up. The transition between the drain pump and the hose may sometimes provide a funnel like profile or other flow restriction that also increases the likelihood of forming a clog. The dishwasher 10 may also comprise a check valve 62 (shown in FIGS. 6A and 7A) for closing the drain pump 60 to prevent soil and water from re-entering the dishwasher 10. The check valve 62 may be further configured to open upon activation of the drain pump 60 and close upon deactivation of the drain pump 60.

With reference to FIG. 1, particular operational components (e.g., water valve 50, drain pump 60, corresponding hoses and wires, etc.) may be housed, disposed, or otherwise positioned within a base portion 22 positioned beneath the tub 12. In some instances, the base portion 22 may be a separate component with respect to the tub 12, such as, for example, a molded polymer component, while in other instances the base portion 22 may be integral with the tub 12 such that the side walls forming the tub 12 or a frame that supports the tub 12 also at least partially form the base portion 22.

The dishwasher 10 typically includes wash programs having various parameters of the dishwashing process. In particular, the dishwasher 10 may be in an operating mode (e.g., rinse cycle, dry cycle, etc.) when using these wash programs, which may require providing water to the dishwasher 10 to clean dishware, utensils, or the like. Thus, with reference to FIG. 2, the dishwasher 10 may at least partially fill with water provided by the water valve 50 to the spray arms 20 via a circulation pump (not shown). This water may form a water level 55 inside the tub 12 of the dishwasher 10.

As shown in FIG. 3, if a clog 70 forms in the drain hose 35, water 58 may be prevented from draining properly through the drain hose 35. Thus, too much water may remain in the tub 12, possibly causing the water to overfill when the dishwasher receives subsequent fills, break the seal of the door 18 and leak outside of the tub 12 of the dishwasher 10. This overfill condition may also correspond to the water level 55 reaching a pre-determined threshold level 25. In this regard, embodiments of the present invention may be implemented in a dishwasher 10 to remove a clog 70 from a drain hose 35 to prevent flooding or overfilling in the dishwasher 10. As discussed herein, a clog may include either a fully developed clog or a forming clog.

According to one embodiment, the dishwasher 10 may comprise at least one detection device 30 for monitoring the water level 55 and detecting an overfill condition in the tub 12, which may result from a clog 70 in the drain hose 35. The detection device 30 may be configured to indirectly or directly detect a clog 70 in the drain hose 35. In the depicted embodiment, the detection device 30 is configured to detect when the water level 55 reaches the threshold level 25, thereby signaling an overfill condition. The detection device 30 may be any type of device that can detect an overfill condition (e.g., a particularly placed sensor, a float, or the like) and can be located inside the tub 12 to detect the water level 55 of the dishwasher 10. The detection device 30 may also be configured to detect removal of the clog 70 in the drain hose 35 or removal of the overfill condition. For example, the detection device 30 may be configured to detect when the water level 55 recedes below the threshold level 25, indicating a removal of the clog and/or overfill condition. One example of a detection device and system for preventing overfilling in a dishwasher is further described in U.S. patent application Ser. No. 12/827,784, which is assigned to the assignee of the present invention, and which is hereby incorporated by reference in its entirety. Thus, as described herein, embodiments of the present invention may be advantageously used in connection with other methods, systems, devices, and operating routines of a dishwasher.

In other embodiments, the detection device 30 may directly or indirectly detect a clog or forming clog. For example, the detection device may be configured to monitor the rate of water level change during draining, such that a slower than normal drainage rate could be identified, thereby indicating the presence of a clogged drain. Additionally, a forming clog could be identified and the drain routine could be executed even before the clog is fully developed, which would improve the success rate for removing the forming clog. Additionally or alternatively, the detection device may comprise a water sensing device, such as a conductivity probe, which could be placed in the flow path of the draining water. The detection device may then be configured to sense when water is present in the drain hose, such that if water should not be in the drain hose, the drain routine could be executed. In another embodiment, the detection device may comprise a pressure switch or transducer placed in the drain circuit. The pressure switch could determine the pressure level of the water or air in the drain hose and identify a clog based on the rate of pressure dissipation in the drain hose.

Additionally, a control device 40 can be used to communicate with certain components of the dishwasher 10. The control device 40 may be housed inside the base portion 22 of the tub 12 or other location so as to facilitate communication with various components of the dishwasher 10. In the depicted embodiment, the control device 40 is housed in the base portion 22 of the tub 12 and is configured to communicate with the water valve 50, drain pump 60, and detection device 30. In this way, the control device 40 can determine whether the drain pump 60 is activated or deactivated and the water valve 50 is opened or closed as well as being able to actuate or deactuate the drain pump 60 and open or close the water valve 50. Also, the control device 40 may be configured to determine if the detection device 30 is actuated/de-actuated due to a clog or an overfill condition or if the detection device's 30 actuation/de-actuation is due to the removal of the clog or overfill condition. Furthermore, the control device 40 may be configured to communicate with the dishwasher 10 to determine if the dishwasher 10 is in an operating mode, and more particularly, whether the dishwasher 10 requires water to be circulated or drained. In some embodiments, the control device 40 may be configured to detect a clog in the drain hose and detect removal of the clog in the drain hose.

The control device 40 may be any type of device that can communicate with the components of the dishwasher 10, electronically, mechanically, or otherwise. In one embodiment, the control device 40 may include a memory for storing of programming, routines, values and variables. In one embodiment, the control device 40 is a microprocessor or other processor configured to perform the functions described herein and may operate under the control of software. The control device 40 may be configured to automatically control the water valve and drain pump in response to receiving a signal indicative of a clog or an overfill condition. For example, in some embodiments, the control device may be further configured to execute a drain routine in response to the detection device 30 detecting a clog 70 in the drain hose 35. In such a regard, the control device 40 may be configured to execute any of the embodiments or variations of the operation routine or drain routine as described herein.

In other embodiments, the control device 40 may be further configured to indicate or otherwise provide error message signals by either storing them in the control device 40 for later access by a user, signaling the dishwasher 10 to display the error message to the user, or other indicating means. Thus, the control device 40 may be configured to signal a drain clog error in response to the detection device 30 detecting an overfill condition a predetermined number of times.

As noted herein, soils exiting the dishwasher 10 through the drain hose 35 may become trapped, thereby clogging the drain hose 35 and preventing water and other soils from properly draining from the dishwasher 10. Once the drain hose 35 is clogged, a normal drain cycle will not remove the material, and further operation of the drain pump 60 can act to set the clog even harder. Alternatively, attempting clog removal by using a vacuum to pull from the downstream side also wedges the clog harder into the restriction. To clear the clog the consumer would have to remove or uninstall the dishwasher 10 from its position under the counter and then remove the drain hose 35. In order to facilitate unclogging of a drain hose, embodiments of the present invention provide methods and associated systems for removing a clog from a drain hose while it remains in a dishwasher.

FIG. 4 illustrates a flow chart of one embodiment of a method for removing a clog from a drain hose in a dishwasher. The operation routine 100 comprises operating a dishwasher during at least one operating mode at 105. The at least one operating mode may be any function that the dishwasher is configured to perform. For example, the operating mode may be running a wash cycle or filling the dishwasher with water. Additionally, the operating mode may comprise removing a clog from the drain hose in the dishwasher.

At any time during operation of the dishwasher, the operation routine 100 may comprise determining whether a clog exists at 115. As described herein, the detecting of a clog may include detecting an overfill condition. If the operation routine 100 does not detect a clog, the operation routine returns to operating the dishwasher as normal.

Upon detection of a clog, however, the operation routine 100 may execute a drain routine 120. In some embodiments, the drain routine 120 may comprise repeatedly activating and deactivating the drain pump to facilitate removal of the clog. In other embodiments, the drain routine 120 may comprise repeatedly activating and deactivating the drain pump until the overfill condition is removed. "Repeatedly activating and deactivating" the drain pump may include activating/deactivating the drain pump at least one time. As described herein, repeatedly activating and deactivating the drain pump may comprise repeating the step of activating the drain pump for a pre-determined time period and deactivating the drain pump for another pre-determined time period.

In the depicted embodiment, the drain routine 120 comprises activating the drain pump for a first amount of time equal to X at 122. After time X elapses, the drain routine 120 further comprises deactivating the drain pump for a second amount of time equal to Y at 124. The activation and deactivation of the drain pump may be repeated a pre-determined number of times equal to B at 126. Finally, the drain routine 120 comprises activating the drain pump for a third amount of time equal to Z at 128. In some embodiments, time Z may be different than time X and may correspond to fully draining the dishwasher, such as using a 90-second drain. X, Y, and Z may be customizable as any pre-determined length of time (e.g., 10 seconds, 2.5 seconds, 1 minute, etc.). B may be customizable as any pre-determined number (e.g., 2, 10, etc.) or may correspond to an amount of time (e.g., 20 seconds, 1 minute, etc.).

Upon exiting the drain routine 120, the operation routine 100 may comprise detecting for removal of the clog at 129. If the clog is removed, the operation routine 100 may return to operating the dishwasher at 105. If removal of the clog is not detected, however, the operation routine 100 may further comprise determining if the drain routine 120 has been performed a number of times equal to C at 130. If the drain routine 120 has not been performed C times, then the operation routine 100 comprises returning to step 115 to detect for a clog. However, if the drain routine 120 has been performed C times, then the operation routine 100 comprises signaling a DRAIN ERROR at 140, which could be any perceptible signal provided to a user (e.g., an audible or a visual alarm). In other embodiments, the operation routine 100 may further comprise ceasing operation of the dishwasher. C may be customizable as any pre-determined number (e.g.,2, 4, etc.) or may correspond to an amount of time (e.g., 20 seconds, 1 minute, etc.).

In some embodiments, the operation routine 100 may comprise detecting removal of a clog or an overfill condition at any point in the operation routine 100 or drain routine 120. In response to detecting removal of the clog or overfill condition, the operation routine 100 may comprise ceasing the operation routine 100 or drain routine 120 and resuming operation of the dishwasher at step 105.

FIG. 5 shows another embodiment of a method for removing a clog from a drain hose in a dishwasher. In some embodiments, a drain routine 200 may be executed in place of or in addition to the drain routine 120 described above with respect to FIG. 4. The drain routine 200 may comprise pre-determined lengths of time X and Y that vary between repeating steps of activation and deactivation. For example, in the depicted embodiment, the drain routine 200 may comprise activating the drain pump for 10 seconds at 205 and deactivating the drain pump for 2 seconds at 210. Then the drain routine 200 may comprise drain pump activation for 10 seconds at 215 and deactivation for 2 seconds at 220. Next, the drain routine may comprise activating the drain pump for 2 seconds at 225 and deactivating the drain pump for 1 second at 230. Then, the drain routine 200 may repeat the steps of drain pump activation for 2 seconds at 235 and deactivation for 1 second at 240, followed by another repeat of the steps of drain pump activation for 2 seconds at 245 and deactivation for 1 second at 250. The drain routine 200 may then comprise activating the drain pump for 10 seconds at 255 and deactivating the drain pump for 2 seconds at 260. Finally, the drain routine 200 may comprise activating the drain pump for 90 seconds to clear the clog from the drain hose at 265.

FIGS. 6-11 illustrate the removal of a clog 70 from a drain hose 35 through embodiments of present invention as described herein. As described with respect to FIGS. 6-11, certain features or events may also reference specific steps in the flow chart of FIG. 4.

FIG. 6 illustrates a clogged drain hose 35 in a dishwasher 10. In the depicted embodiment, the clog 70 may comprise a mixture of heavy and light soils that are stuck in the drain hose 35, thereby preventing water 58 from completely draining from the dishwasher 10. As shown in FIGS. 6 and 6A, during the drain routine 120 at step 122 when the drain pump 60 is activated for a first pre-determined time, the check valve 62 opens and the drain pump 60 begins pumping water out of the dishwasher 10. Since the clog is at least partially blocking the drain hose 35, some water 58 surrounds the clog 70 and remains in the drain hose 35.

FIG. 7 illustrates the instance where the drain pump is deactivated. In particular, as shown in FIG. 7A, when the drain pump 60 is deactivated, the check valve 62 closes potentially allowing a small volume of drain solution to go back from the drain hose into the drain pump and then water ceases to enter the drain hose 35. In the depicted embodiment, closing of the check valve 62 causes a first air break 37 in the drain hose 35 to form at the highest point of the drain hose 35 and a second air break 38 in the drain hose 35 to possibly form in the drain hose 35 below (upstream of) the clog. These air breaks 37, 38 isolate the water 58 in a water column 56 inside the drain hose 35.

As shown in FIG. 8, the water column 56 falls due to the force of gravity. The water column 56, which may surround the clog 70, thereby causes a shift in the clog 70. The shift in the clog 70 may upset the compaction of soil and release or dislodge some of the soil (i.e., some smaller soils may release from the clog).

As described above, the drain pump 60 may be repeatedly activated/deactivated. As shown in FIG. 9, water 58 enters the drain hose 35 and interacts with the clog 70. The water may pass through the clog 70, and due to the shifting of the clog in the previous steps of the drain routine, some water may be able to remove the smaller soils 72 out of the drain hose 35 through the home's plumbing. Then, upon repeating deactivation of the drain pump, a water column 56 forms and shifts the clog 70 by the force of gravity, as illustrated in FIG. 10.

As described above, activation and deactivation of the drain pump may be repeated any number of times. Eventually, with reference to FIG. 11, after enough shifting of the clog 70 and removal of the smaller soils 72, the water will be able to enter the drain hose 35 and completely remove the clog through the home's plumbing, thereby removing the clog from the drain hose 35 of the dishwasher 10.

As described herein, FIGS. 4 and 5 are flowcharts of methods, systems and program products according to various embodiments of the present invention. It will be understood that each block or step of the flowchart, and combinations of blocks in the flowchart, can be implemented by computer program instructions. These computer program instructions may be loaded onto a computer, processor, or other programmable apparatus to produce a machine, such that the instructions which execute on the computer, processor, or other programmable apparatus create means for implementing the functions specified in the flowchart block(s) or step(s). These computer program instructions may also be stored in a computer-readable memory that can direct a computer, processor, or other programmable apparatus to function in a particular manner, such that the instructions stored in the computer-readable memory produce an article of manufacture including instruction means which implement the function specified in the flowchart block(s) or step(s). The computer program instructions may also be loaded onto a computer, processor, or other programmable apparatus to cause a series of operational steps to be performed on the computer, processor, or other programmable apparatus to produce a computer implemented process such that the instructions which execute on the computer, processor, or other programmable apparatus provide steps for implementing the functions specified in the flowchart block(s) or step(s).

Accordingly, blocks or steps of the flowchart support combinations of means for performing the specified functions, combinations of steps for performing the specified functions and program instruction means for performing the specified functions. It will also be understood that each block or step of the flowchart, and combinations of blocks or steps in the flowchart, can be implemented by special purpose hardware-based computer systems which perform the specified functions or steps, or combinations of special purpose hardware and computer instructions.

Embodiments of the present invention may provide an effective means for removing clogs in a drain hose of a washing appliance. One exemplary advantage of the present invention is that some embodiments may be implemented in existing operation routines of washing appliances using existing operational components. Thus, embodiments of the present invention allow for inexpensive and easy implementation while still effectively removing clogs in the drain hose, thereby preventing flooding or overfilling and allowing for more effective cleaning.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A method of manufacturing a dishwasher for removing a clog from a drain hose, the method comprising the steps of:

providing a dishwasher comprising:

a drain pump configured to remove water from the dishwasher;

a drain hose in fluid communication with the drain pump;

a detection device configured to detect a clog in the drain hose; and a control device in operable communication with the drain pump; and configuring the control device to execute, in response to detecting the clog in the drain hose, a drain routine to facilitate removal of the clog, wherein the drain routine comprises:

activating the drain pump for a first time period;

deactivating the drain pump for a second time period;

repeating activation of the drain pump for the first time period and deactivation of the drain pump for the second time period at least once; and activating the drain pump for a third time period, wherein the third time period is different than the first time period.

2. The method of claim 1, wherein configuring the control device further comprises configuring the control device to:

determine if the clog has been removed after execution of the drain routine; and repeat execution of the drain routine if the clog has not been removed.

3. The method of claim 2, wherein configuring the control device further comprises configuring the control device to:

determine if the number of times the drain routine has been performed exceeds a threshold number of times; and signal a drain clog error if the number of times the drain routine has been performed exceeds the threshold number of times.

4. The method of claim 1, wherein activating the drain pump comprises turning on the drain pump so as to facilitate removal of water from the dishwasher, and wherein deactivating the drain pump comprises pausing the drain pump so to stop removing water from the dishwasher.

5. A system for removing a clog from a drain hose in a dishwasher, the system comprising:

a drain pump configured to remove water from the dishwasher;

a drain hose in fluid communication with the drain pump;

a detection device configured to detect a clog in the drain hose; and a control device in operable communication with the drain pump and configured to execute, in response to detecting a clog in the drain hose, a drain routine to facilitate removal of the clog, wherein the drain routine comprises:

activating the drain pump for a first time period;

deactivating the drain pump for a second time period;

repeating activation of the drain pump for the first time period and deactivation of the drain pump for the second time period at least once; and activating the drain pump for a third time period, wherein the third time period is different than the first time period.

6. The system of claim 5, wherein the control device is configured to:

determine if the clog has been removed after execution of the drain routine; and repeat execution of the drain routine if the clog has not been removed.

7. The system of claim 6, wherein the control device is further configured to:

determine if the number of times the drain routine has been performed exceeds a threshold number of times; and signal a drain clog error if the number of times the drain routine has been performed exceeds the threshold number of times.

8. The system of claim 5, wherein the control device is configured to provide a signal to resume operation of the dishwasher upon removal of the clog.

9. A computer program product for removing a clog from a drain hose in a dishwasher, the dishwasher comprising a drain pump for removing water from the dishwasher and in fluid communication with the drain hose, wherein the dishwasher further comprises a detection device configured to detect a clog in the drain hose, the computer program product comprising a non-transitory computer readable storage medium having computer readable program code portions stored therein, the computer readable program code portions being configured when said program product is run by a control device of the dishwasher, to:

execute, in response to detecting a clog in the drain hose, a drain routine to facilitate removal of the clog, wherein the drain routine comprises:

activating the drain pump for a first time period;

deactivating the drain pump for a second time period;

repeating activation of the drain pump for the first time period and deactivation of the drain pump for the second time period at least once; and activating the drain pump for a third time period, wherein the third time period is different than the first time period.

10. The method of claim 1, wherein the second time period is shorter than the first time period.

11. The method of claim 10, wherein the second time period is two seconds, and the first time period is ten seconds.

12. The method of claim 1, wherein the third time period is longer than each of the first time period and the second time period.

13. The method of claim 1, wherein the first time period is designed such that water entering the drain hose surrounds the clog, and wherein the second time period is designed to form a first air break downstream of the clog and a second air break upstream of the clog to isolate the water and clog such that the water and the clog shift due to gravity to upset compaction of the clog and release or dislodge soil within the clog.

14. The method of claim 1, wherein the first time period and the second time period are based, at least in part, on the configuration of the drain pump and the drain hose.

15. The method of claim 1, wherein the detection device is configured to detect the clog by determining if a rate of water level change during draining is slower than a threshold rate of water level change during draining.

16. The method of claim 1, wherein the detection device is positioned within a flow path of water draining through the drain hose, and wherein the detection device is configured to detect the clog by determining if water is present in the flow path at a time in which water should not be present in the flow path.

17. The system of claim 5, wherein the second time period is shorter than the first time period.

18. The system of claim 17, wherein the second time period is two seconds, and the first time period is ten seconds.

19. The system of claim 5, wherein the third time period is longer than each of the first time period and the second time period.

20. The system of claim 5, wherein the first time period is designed such that water entering the drain hose surrounds the clog, and wherein the second time period is designed to form a first air break downstream of the clog and a second air break upstream of the clog to isolate the water and clog such that the water and the clog shift due to gravity to upset compaction of the clog and release or dislodge soil within the clog.

21. The system of claim 5, wherein the first time period and the second time period are based, at least in part, on the configuration of the drain pump and the drain hose.

22. The system of claim 5, wherein the detection device is configured to detect the clog by determining if a rate of water level change during draining is slower than a threshold rate of water level change during draining.

23. The system of claim 5, wherein the detection device is positioned within a flow path of water draining through the drain hose, and wherein the detection device is configured to detect the clog by determining if water is present in the flow path at a time in which water should not be present in the flow path.

24. The computer program product of claim 9, wherein the second time period is shorter than the first time period.

25. The computer program product of claim 24, wherein the second time period is two seconds, and the first time period is ten seconds.

26. The computer program product of claim 9, wherein the third time period is longer than each of the first time period and the time period.

27. The computer program product of claim 9, wherein the first time period is designed such that water entering the drain hose surrounds the clog, and wherein the time period is designed to form a first air break downstream of the clog and a second air break upstream of the clog to isolate the water and clog such that the water and the clog shift due to gravity to upset compaction of the clog and release or dislodge soil within the clog.

* * * * *